United States Patent [19]

Borkowski et al.

[11] 4,028,152

[45] June 7, 1977

[54] EXPLOSIVE COMPOSITION CONTAINING HIGH DENSITY HYDROCARBON LIQUID

[75] Inventors: Walter L. Borkowski, Media; Abraham Schneider, Overbrook Hills, both of Pa.

[73] Assignee: Suntech, Inc., St. Davids, Pa.

[22] Filed: Mar. 29, 1976

[21] Appl. No.: 671,634

[52] U.S. Cl. ..... 149/46; 149/45; 149/61; 102/23

[51] Int. Cl.[2] ..... C06B 31/28

[58] Field of Search ..... 149/46, 45, 41, 61; 102/23

[56] References Cited

UNITED STATES PATENTS 3,240,641 3/1966 Wilson ..... 149/46

*Primary Examiner*—Stephen J. Lechert, Jr.
*Attorney, Agent, or Firm*—Donald R. Johnson; J. Edward Hess; Anthony Potts, Jr.

[57] ABSTRACT

A blasting composition comprising a mixture of inorganic nitrate, e.g., ammonium nitrate, and a high density hydrocarbon liquid has substantially more explosive force than an equal volumetric amount of a mixture of ammonium nitrate and diesel fuel. The latter is a commercial explosive currently used in large quantities. A high density hydrocarbon liquid is one having a density $\geq 0.910$; net heating value $\geq 135{,}000$ BTU/-gal., and a pour point $\leq -30°$ F. Examples of such hydrocarbons include exo-tetrahydrodicyclopentadiene or a mixture of $C_{14}H_{18}$ hexacyclic dimers of norbornadiene. Also disclosed is an improved method of blasting.

15 Claims, No Drawings

EXPLOSIVE COMPOSITION CONTAINING HIGH DENSITY HYDROCARBON LIQUID

BACKGROUND OF THE INVENTION

1. Field of the Invention

This invention is directed to a new and useful improvement to an explosive. In particular it is directed to an improved explosive useful as a blasting composition. More particularly it is directed to a blasting composition containing a nitrate and a nonexplosive sensitizer. Even more particularly it is directed to a nonexplosive sensitizer which is carbonaceous. And the improvement resides in the selection of the carbonaceous sensitizer and in particular a hydrocarbon sensitizer. A sensitizer increases the tendency of an explosive material towards detonation. The invention is also directed to an improved method of blasting using the aforementioned blasting composition.

2. Description of the Prior Art

Use of a mixture of inorganic nitrates in an explosive is known, see U.S. Pat. No. 3,367,805. Use of a mixture of inorganic nitrates, including ammonium nitrate, and a combustible organic material is known, see Kirk-Othmer, ENCYCLOPEDIA OF CHEMICAL TECHNOLOGY, 2nd Edition, Vol. 8, section titled "Explosives". Use of a mixture of ammonium nitrate and a certain hydrocarbon, such as diesel fuel, as an explosive is known, see U.S. Pat. No. 3,061,488, or THE SCIENCE OF HIGH EXPLOSIVES, M. A. Cook, publisher American Chemical Society, 1958, ACS Monograph Series No. 139 or *Iron Ore Co. of Canada v. Dow Chemical Co.*, 177 USPQ 33.

A mixture of prilled ammonium nitrate (about 94%) and diesel fuel (about 6%) is a commercial explosive used in large quantities in blasting. The foregoing mixture will be termed AN-DF hereinafter. Blasting refers to industrial and engineering operations wherein mechanical work is performed such as quarrying, ore dislodgement, ditching, excavating, etc., with a low expenditure of time and money. Blasting is used in open pit mining of coal, iron ore, shale oil, tar sands, salt and the like. Details of blasting are discussed in ENCYCLOPEDIA BRITANNICA, Vol. 3, Library of Congress Catalog Card No. 69-10039.

An AN-DF mixture can be considered an oxygen-balanced mixture for the following reason. When only ammonium nitrate is decomposed the products generally are nitrogen, water and oxygen. Thus by itself ammonium nitrate contains an excess of oxygen. However, if diesel fuel is added to the ammonium nitrate in a sufficient amount so that there is enough carbon and hydrogen to stoichiometrically react with the excess oxygen, the mixture is said to be balanced as to the available oxygen. As a result the formation of the additional gases, that is, $CO_2$ and $H_2O$ by the reaction of the carbon and hydrogen of the diesel fuel with the excess oxygen from ammonium nitrate substantially increases the explosive forec of AN-DF mixture compared to just ammonium nitrate.

An AN-DF mixture is often used in the following manner. A hole is drilled into the rock, for example. A suitable amount of the loose, unpackaged AN is poured into the hole followed by a sufficient amount of DF. The resulting mixture is confined and detonated by a suitable blasting cap. Confinement refers to the practice of filling the remainder of the hole with drilled material or other substances such as rock. Confinement increases the efficiency of the explosion.

However, when blasting in a cold environment a problem can occur. The problem occurs because a typical diesel fuel's pour point is about −10° to −20° F. Pour point is a temperature at which an oil ceases to flow. Thus the use of AN-DF mixture can be restricted by the ambient temperature. Furthermore, at a lower temperature, but above a pour point, the diesel fuel's viscosity may be high so that when it is poured into a drilled hole containing ammonium nitrate it does not properly fill the hole. Also under such conditions the diesel fuel may not flow into the voids between the ammonium nitrate particles. For either one or both reasons, when the AN-DF mixture is detonated, the maximum possible force is not obtained thereby increasing costs.

SUMMARY OF THE INVENTION

The foregoing low temperature problem is avoided by use of applicants' improved blasting composition. The latter contains an inorganic nitrate, such as ammonium nitrate, or a mixture of nitrates and certain liquid hydrocarbons.

The hydrocarbon is a high density hydrocarbon liquid having a density $\geq 0.910$; a net heating value of $\geq$ 135,000 BTU/gallon; a pour point of $< -30°$ F. Use of the foregoing hydrocarbon has many advantages over diesel fuel. Among the advantages is that, for example, the hydrocarbon can have a pour point which is extremely low, e.g. 60° F; some are even liquid at −112° F; a net heating value as high as about 159,000 BTU/gallon compared to about 127,000 BTU/gallon for diesel fuel; a density of about 1.07 compared to about 0.87 for diesel fuel.

Furthermore, because the foregoing hydrocarbons have such higher heating values more blasting force can be obtained from the material contained in a given size hole. Also because they have such higher densities and greater low temperature fluidities, more nitrate can be placed in a given size hole which results in more blasting force per hole. Thus less holes need to be drilled. Another advantage is that a smaller hole can be used without reducing the blasting force. It should be realized that the number of holes drilled or the size of the hole drilled can be economically important since drilling amounts to an appreciable part of the cost in blasting. Another advantage results because the foregoing hydrocarbons are so much denser than the fuel oil. The increased density means that much less material has to be transported. For operations within the Artic Circle, for example, transportation costs far exceed the initial purchase price of the material. Thus a large saving results from reducing transportation costs.

Another advantage of present invention results from the fact that the high density hydrocarbon liquid is less viscous than diesel fuel at very low temperature. Because of the lower viscosity, a more finely ground ammonium nitrate, i.e., a higher bulk density ammonium nitrate, could be used. And even with the higher bulk density nitrate the use of the high density hydrocarbon liquid results in the uniform wetting of the nitrate thereby, resulting in a more efficient explosion. The use of a higher bulk density nitrate permits more nitrate to be placed on a given size hole and thus less holes have to be drilled.

DESCRIPTION OF THE INVENTION

The inorganic nitrate used in this invention includes ammonium nitrate ($NH_4NO_3$) and sodium nitrate ($NaNO_3$), which are preferred, and other nitrates such as potassium, calcium and magnesium. Thus the inorganic nitrate is selected from the group consisting of ammonium nitrate, mixture of a major amount of ammonium nitrate and a minor amount of sodium nitrate, potassium nitrate, calcium nitrate and magnesium nitrate. The minor nitrate can be just one particular nitrate or a mixture of two or more nitrates. The nitrate should be of sufficient quality to permit its use as an explosive. For example, according to Kirk-Othmer, supra, ammonium nitrate used in the manufacture of military explosive is required to be at least 99.0% pure, and contains no more than 0.02% free nitric acid, 0.05% sulfate, 0.18% water-insoluble material, 0.10% ether-insoluble material, and 0.05% chloride; it also should be free of alkalinity and nitrites. It is also reported that the commercial grade used in the manufacture of blasting explosive should be of comparable purity. Either the crystalline aggregate or prills (spherical pellets) form of the ammonium nitrate can be used. The ammonium nitrate should be free of large amounts of any additive, such as mineral filler, which would adversely effect the performance or efficiency of the explosive. However, smaller amounts of such additives may be tolerated. Filler is often used to prevent the ammonium nitrate from caking.

Sodium nitrate can be mixed with the ammonium nitrate. The sodium nitrate increases the available oxygen content. The sodium nitrate can be natural material from Chile known as Chilean nitrate or the synthetic material produced, for example, via the neutralization of synthesized nitrogen oxides. Either works substantially equally well. Sodium nitrate is available in crystalline or prill form. However, the sodium nitrate should be free of large amounts of any additive which would seriously adversely effect the performance or efficiency of the explosive. Smaller amounts of such additives could be tolerated.

Analogous standards, as to the aforementioned, apply to the other inorganic nitrates if they are mixed with the ammonium nitrate or sodium nitrate.

When a mixture of ammonium nitrate and other inorganic nitrates are used the ammonium nitrate will comprise generally a major amount and the other nitrates a minor amount. Usually the ammonium nitrate will comprise 65% by weight or more of the total inorganic nitrate content and preferably 75% by weight or more.

The hydrocarbon used herein is a high density hydrocarbon liquid. A high density hydrocarbon liquid is characterized by the following properties: a density $\geq$ 0.910; net heating value $\geq$ 135,000 BTU/gallon; pour point $<$ −30° F. A preferred high density hydrocarbon liquid has the following properties: a density $\geq$ 0.930; a heating value $\geq$ 140,000 BTU/gallon; pour point $<$ −35° F. Example of high density hydrocarbon liquids include exotetrahydrodicyclopentadiene, or a liquid mixture of at least two of the following:

a. exo-exo $C_{14}H_{18}$ hexacyclic dimer of norbornadiene;

b. endo-endo $C_{14}H_{18}$ hexacyclic dimer of norbornadiene;

c. exo-endo $C_{14}H_{18}$ hexacyclic dimer of norbornadiene;

d. endo-exo $C_{14}H_{18}$ hexacyclic dimer of norbornadiene.

The foregoing stereoisomers individually have relatively high melting points, however, when used as together in a mixture the melting point of the mixture is substantially reduced. Thus by use of various proportions of two or more of the stereoisomers the resulting liquid has an extremely low freezing point. The foregoing mixture can also contain small amounts of other high density hydrocarbons which were prepared during the manufacture of the $C_{14}H_{18}$ dimer. However, if too much of these other hydrocarbons are present they would reduce the efficiency of the reaction and/or increase the freezing point and therefore should be avoided.

Norbornadiene is also known as bicyclo (2.2.1) heptadiene-2.5. It is a $C_7H_8$ bicyclic, diolefinic hydrocarbon. A method of preparation is disclosed in U.S. Pat. No. 2,875,256, issued Feb. 24, 1959. Norbornadiene is referred to as NBD hereinafter. NBD can be represented by either one of the following structural formulas:

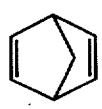

or

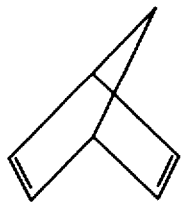

NBD can be dimerized into four stereoisomers. These stereoisomers are monoolefinic, $C_{14}H_{16}$, hexacyclic hydrocarbons. These stereoisomers can be represented by the following structural formulas:

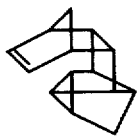

Endo-Endo

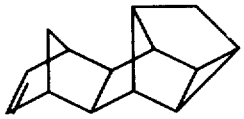

Exo-Exo

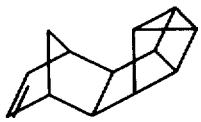

Exo-Endo

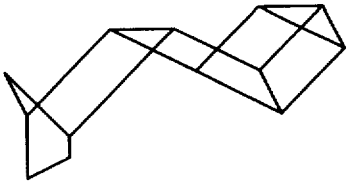

Endo-Exo

Dimerization of NBD is disclosed in U.S. Pat. No. 3,377,398, issued Apr. 9, 1968. The disclosed process results in the production of various dimer mixtures. The process therein involves the use of an iron catalyst system, e.g., ferric acetylacetonate and triethylaluminum, and a temperature above 140° C. The product of said method is a mixture which includes both the monoolefinic hexacyclic and diolefinic pentacyclic dimers. U.S. Pat. No. 3,282,663, issued Nov. 1, 1966, discloses the dimerization of NBD to both pentacyclic and hexacyclic dimers. These dimers can be separated into relatively pure fractions. U.S. Pat. No. 3,329,732, issued July 4, 1967, discloses an improved method for the dimerization of the NBD. The catalyst comprises certain metal salts of the tetracarbonylcobaltate anion wherein the metal is zinc, cadmium, mercury or indium. Resulting dimer mixture contains predominantly hexacyclic dimers.

The foregoing stereoisomers are monoolefinic. Hence hydrogenation of the monoolefinic hexacyclic dimer to the saturated dimer improves its stability towards oxidation. As a result storage problems are substantially reduced. After hydrogenation the $C_{14}H_{16}$ hexacyclic dimer of norbornadiene becomes a $C_{14}H_{18}$ dimer.

U.S. Pat. No. 3,326,992, issued June 20, 1967, discloses the partial hydrogenation of NBD dimer mixtures.

Complete hydrogenation of a $C_{14}H_{16}$ NBD dimer to a $C_{14}H_{18}$ NBD dimer can be obtained when using a conventional hydrogenation catalyst such as Adams catalyst ($PtO_2$) and contacting both with hydrogen at a low pressure, for example, 50 psig, at an ambient temperature. A suitable solvent can be used.

The aforementioned exo-tetrahydrodicyclopentadiene can be prepared by hydrogenating dicyclopentadiene in the presence of Ni-on-Kieselguhr catalyst at a temperature of about 100° C and at a pressure of about 100 psig. The resulting hydrogenated material (endo-tetrahydrodicyclopentadiene) or THDC can be converted to its exo form by contacting it with aluminum trichloride catalyst at a temperature of about 60°–80° C. The foregoing processing steps can be illustrated by the following reactions:

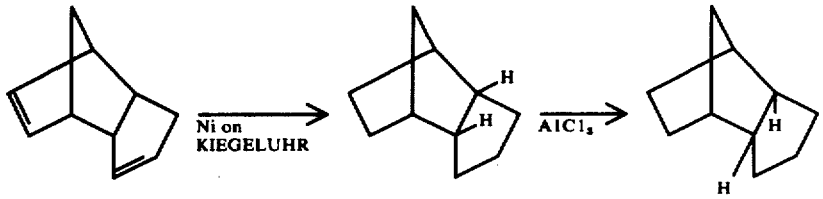

Dicyclopentadiene Endo-THDC Exo-THDC

The endo-THDC has a melting point of 170.6° F, whereas the exo THDC is liquid at −112° F, has a density of 0.936 and a net heating value of 141,720 BTU/-gallon.

To practice the invention, for example, a suitable amount of the mixture of $C_{14}H_{18}$ hexacyclic dimers of NBD is incorporated into an inorganic nitrate or mixture thereof. The amount of the dimer is such that an oxygen balance of about ± 15% is obtained. One way of defining a 100% oxygen balance is that all of the oxygen in the nitrate is converted to an oxide. Another way of defining an oxygen balance is that all of the oxygen is stoichiometrically used if the reaction is 100% complete. Thus if the reaction is 100% complete all the carbon in the dimer is converted to $CO_2$, and all the hydrogen in the dimer is converted to $H_2O$, and all of the hydrogen in ammonium nitrate is converted to $H_2O$ while the nitrogen in the nitrate is released as nitrogen.

The foregoing can be illustrated by the following equation in which only ammonium nitate is used:

$$37NH_4NO_3 + C_{14}H_{18} \rightarrow 37N_2 + 83H_2O + 14CO_2 + \text{heat}$$

Thus for a 100% oxygen balance, as represented by foregoing equation, one mode of the dimer is necessary for every 37 moles of ammonium nitrate. Nevertheless, while a 100% oxygen balance is a desirable theoretical amount, practical considerations permit the use of a mixture which has either a reasonable excess or deficiency of oxygen. Tenerally the oxygen balance can be within ± 15% while ± 10% is a preferred value with ± 7.5% more preferred.

In another embodiment the nitrate could be mixed in a processing plant with a high density hydrocarbon which is solid at ambient temperature. Then the resulting mixture could be shipped to its point of use. With this method of processing the high density hydrocarbon need only have a density ≥ −0.910 and a net heating value ≥ 135,000 BTU/gallon. The amount of the hydrocarbon within this embodiment is within ± 15% of an oxygen balance.

ILLUSTRATIVE EXAMPLE

A hole is drilled in the earth with a mechanical drill. The latter can be a rotary drill using a very hard material such as diamonds. Other types of drills such as jet-piercing drills can be used. The depth of the hole can range from a few feet to several hundred feet or more. The diameter of the hole can vary from about 1 to about 12 inches.

After the hole is drilled the desired amount of inorganic nitrate is poured into the hole. As an example, 80 lbs. of ammonium nitrate is poured into a hole of about 0.75 cubic feet. Then about 0.6 of a gallon of a liquid mixture of exo-exo and endo-endo $C_{14}H_{18}$ dimer is poured into the hole containing the ammonium nitrate.

In this example the high density hydrocarbon mixture contains about 31 weight percent of the exo-exo $C_{14}H_{18}$ dimer and about 61 weight percent of the endo-endo $C_{14}H_{18}$ dimer. The remaining material is a mixture of many other high density hydrocarbons such as the pentacyclic dimers of norbornadiene. The foregoing mixture has a pour point of −63° F; note that a 22–70 weight percent mixture would have a pour point of −85° F.

After the nitrate and the dimer mixture is placed in the hole, a blasting cap is added. The hole is confined and then the cap is detonated which in turn sets off the nitrate-dimer mixture. The resulting blast is commercially attractive in that a smaller amount of explosive obtained a blast equal to a larger amount of AN-DF mixture, particularly at low temperatures.

Other mixtures of nitrates, such as one containing ammonium nitrate and sodium nitrate, give analogous results. Also use of other mixtures of dimers, such as a mixture of exo-exo, endo-endo, and exo-endo or endo-endo, exo-endo and endo-exo yield analogous results. Also use of exo-tetrahydrodicyclopentadiene or a mixture of it and the dimers will yield analogous results.

The invention claimed is:

1. An improved method of blasting wherein a hole is drilled and then filled with both an inorganic nitrate or mixture thereof and a liquid hydrocarbon and then a detonator is placed in the hole, and then the nitrate, the hydrocarbon and detonator are confined and then the detonator is activated thereby causing a blast; the improvement comprises that the hydrocarbon is a high density hydrocarbon liquid having a density ≥ 0.910 and a net heating value ≥ 135,000 BTU/gallon and a pour point ≤ −30° F and wherein the amount of hydrocarbon is within ± 15% of an oxygen balance.

2. An improved method according to claim 1 wherein the inorganic nitrate is selected from the group consisting of ammonium nitrate, mixture of a major amount of ammonium nitrate and a minor amount of sodium nitrate, potassium nitrate, calcium nitrate, magnesium nitrate and a mixture of the minor nitrates.

3. An improved method according to claim 1 wherein the amount of the hydrocarbon is within ± 10% of an oxygen balance.

4. An improved method according to claim 1 wherein the hydrocarbon is selected from the group consisting of:

A. liquid mixture of at least two of the following:
   a. exo-exo $C_{14}H_{18}$ hexacyclic dimer of norbornadiene;
   b. endo-endo $C_{14}H_{18}$ hexacyclic dimer of norbornadiene;
   c. exo-endo $C_{14}H_{18}$ hexacyclic dimer of norbornadiene;
   d. endo-exo $C_{14}H_{18}$ hexacyclic dimer of norbornadiene;

B. exo-tetrahydrodicyclopentadiene; and

C. mixture of A and B.

5. An improved method according to claim 3 wherein the inorganic nitrate is ammonium nitrate or a mixture of a major amount of ammonium nitrate and a minor amount of sodium nitrate.

6. An improved method according to claim 5 wherein the amount of the ammonium nitrate in the mixture is at least 65% by weight.

7. An improved method according to claim 6 wherein the amount of the hydrocarbon is within ± 10% of an oxygen balance.

8. An improved method according to claim 7 wherein the hydrocarbon is selected from the group consisting of:

A. liquid mixture of at least two of the following:
   a. exo-exo $C_{14}H_{18}$ hexacyclic dimer of norbornadiene;
   b. endo-endo $C_{14}H_{18}$ hexacyclic dimer of norbornadiene;
   c. exo-endo $C_{14}H_{18}$ hexacyclic dimer of norbornadiene;
   d. endo-exo $C_{14}H_{18}$ hexacyclic dimer of norbornadiene;

B. exo-tetrahydrodicyclopentadiene; and

C. mixture of A and B.

9. A blasting composition comprising a mixture of both

A. an inorganic nitrate selected from the group consisting of ammonium nitrate, mixture of a major amount of ammonium nitrate and a minor amount of sodium nitrate, potassium nitrate, calcium nitrate, magnesium nitrate and a mixture of the minor nitrates; and B. a high density hydrocarbon having a density ≥ 0.910, and a net heating value ≥ 135,000 BTU/gallon and wherein the amount of the hydrocarbon is within ± 15% of an oxygen balance.

10. Composition according to claim 9 wherein the inorganic nitrate is selected from the group consisting of ammonium nitrate and a mixture of a major amount of ammonium nitrate and a minor amount of sodium nitrate and wherein the amount of hydrocarbon is within ± 10% of an oxygen balance.

11. Composition according to claim 10 wherein amount of the ammonium nitrate in the mixture is at least 65% by weight.

12. A composition according to claim 9 wherein the high density hydrocarbon is a liquid having a pour point −30° F.

13. A composition according to claim 12 wherein the liquid hydrocarbon is selected from the group consisting of:

A. a liquid mixture of at least two hydrocarbons selected from the group consisting of:
   a. exo-exo $C_{14}H_{18}$ hexacyclic dimer of norbornadiene;
   b. endo-endo $C_{14}H_{18}$ hexacyclic dimer of norbornadiene;
   c. exo-endo $C_{14}H_{18}$ hexycyclic dimer of norbornadiene;
   d. endo-exo $C_{14}H_{18}$ hexacyclic dimer of norbornadiene;

B. exo-tetrahydrodicyclopentadiene; and

C. mixture of A and B.

14. Composition according to claim 13 wherein the inorganic nitrate is selected from the group consisting of ammonium nitrate and a mixture of a major amount of ammonium nitrate and a minor amount of sodium nitrate and wherein the amount of the hydrocarbon is within ± 10% of an oxygen balance.

15. Composition according to claim 14 wherein amount of the ammonium nitrate in the mixture is at least 65% by weight.

* * * * *